United States Patent [19]

Ridley

[11] 4,153,297

[45] May 8, 1979

[54] GROUND WATER CONTROL FOR AN IN SITU OIL SHALE RETORT

[75] Inventor: Richard D. Ridley, Grand Junction, Colo.

[73] Assignee: Occidental Oil Shale, Inc., Grand Junction, Colo.

[21] Appl. No.: 811,488

[22] Filed: Jun. 30, 1977

[51] Int. Cl.[2] ..... E21C 41/10

[52] U.S. Cl. ..... 299/2; 405/39

[58] Field of Search ..... 61/0.5, 11, 35; 299/2, 299/13, 19, 4

[56] References Cited

U.S. PATENT DOCUMENTS

| | | | |
|---|---|---|---|
| 2,481,051 | 9/1949 | Uren | 299/2 |
| 3,026,096 | 3/1962 | Love | 61/11 |
| 3,589,773 | 6/1971 | Dixon | 61/11 |
| 4,022,511 | 5/1977 | French | 299/2 |
| 4,043,595 | 8/1977 | French | 299/13 |

OTHER PUBLICATIONS

Mining Engineers Handbook, Robert Peele, ed., John Wiley and Sons, N.Y. 1941, pp. 02-07, chapter 13.

*Primary Examiner*—William Pate, III

*Attorney, Agent, or Firm*—Christie, Parker & Hale

[57] ABSTRACT

An in situ oil shale retort is formed in a subterranean formation containing oil shale. The retort contains a fragmented permeable mass of particles containing oil shale. An open base of operation is excavated in the formation above the retort site, and an access drift is excavated to the bottom of the retort site. Formation is explosively expanded to form the fragmented mass between the access drift and an elevation spaced below the bottom of the base of operation, leaving a horizontal sill pillar of unfragmented formation between the top of the fragmented mass and the bottom of the base of operation. The sill pillar provides a safe base of operation above the fragmented mass from which to control retorting operations. A plurality of blasting holes used in explosively expanding the formation extend from the base of operation, through the sill pillar, and open into the top of the fragmented mass. Trenches are formed in the base of operation for collecting ground water which enters the base of operation prior to and during retorting operations, and collected ground water is withdrawn from the base of operation. Casings can be placed in the blasting holes and adapted for controlling gas flow through the fragmented mass during retorting operations. The casings extend above the floor of the base of operation to inhibit flow of ground water through the blasting holes into the fragmented mass, and other blasting holes not having such casings are sealed. After retorting is completed, the floor of the base of operation can be covered with a layer of concrete and/or the blasting holes can be sealed with concrete to inhibit leakage of ground water into treated oil shale particles in the fragmented mass.

17 Claims, 5 Drawing Figures

GROUND WATER CONTROL FOR AN IN SITU OIL SHALE RETORT

BACKGROUND OF THE INVENTION

This application is related to U.S. patent application Ser. No. 603,704 entitled "In Situ Recovery of Shale Oil", filed Aug. 11, 1975, by Gordon B. French, now U.S. Pat. No. 4,043,595, to U.S. patent application Ser. No. 603,705 entitled "Forming Shale Oil Recovery Retort Into Slot-Shaped Columnar Void", filed Aug. 11, 1975, by Richard D. Ridley, now U.S. Pat. No. 4,043,596, and to U.S. patent application Ser. No. 790,350 entitled "In Situ Oil Shale Retort With a Horizontal Sill Pillar" filed Apr. 25, 1977, by Ned M. Hutchins, now U.S. Pat. No. 4,118,071. All three of these applications are assigned to the assignee of the present application and are incorporated herein by this reference.

This invention relates to recovery of liquid and gaseous products from oil shale. The term "oil shale" as used in the industry is in fact a misnomer; it is neither shale, nor does it contain oil. It is a sedimentary formation comprising marlstone deposit with layers containing an organic polymer called "kerogen" which upon heating decomposes to produce hydrocarbon liquid and gaseous products. The formation containing kerogen is called "oil shale" herein, and the hydrocarbon liquid product is called "shale oil".

One technique for recovering shale oil includes forming an in situ oil shale retort in a subterranean formation containing oil shale. At least a portion of the formation within the boundaries of the in situ oil shale retort is explosively expanded to form a fragmented permeable mass of particles containing oil shale. The fragmented mass is ignited near the top of the retort to establish a combustion zone. An oxygen-containing gas is introduced into the top of the retort to sustain the combustion zone and cause it to move downwardly through the fragmented permeable mass of particles in the retort. As burning proceeds, the heat of combustion is transferred to the fragmented mass of particles below the combustion zone to release shale oil and gaseous products therefrom in a retorting and vaporization zone. Vaporized constituuents of shale oil, water vapor and the like may condense on cooler oil shale in the retort below the retorting zone. The retorting zone moves from top to bottom of the retort ahead of the combustion zone, and the resulting shale oil and gaseous products pass to the bottom of the retort for collection and removal. Recovery of liquid and gaseous products from oil shale deposits is described in greater detail in U.S. Pat. No. 3,661,423, to Donald E. Garrett, assigned to the assignee of this application.

In preparing for the retorting process the formation containing oil shale should be fragmented rather than simply fractured to create good and uniform permeability so that undue pressures are not required to pass the gas through the retort, and so that valuable deposits of oil shale are not bypassed owing to non-uniform permeability. The aforementioned patent applications disclose techniques for fragmenting a substantial volume of formation in a retort site to form a fragmented mass of particles in an in situ oil shale retort. The in situ retort is formed by excavating a void in the retort site, drilling blasting holes into the remaining portion of the formation in the retort site, loading explosive into the blasting holes, and detonating the explosive to expand the formation toward the void.

To promote maximum uniformity of particle size and permeability of the fragmented mass, and to minimize the quantity of explosives, the blasting holes should be reasonably accurately located with respect to each other, and with respect to the void toward which expansion occurs during the explosion. Oil shale formations in the western United States are often between 50 to about 500 feet thick or even more, and are covered by a non-productive overburden, which may be thousands of feet deep, thus often making it difficult to drill from the surface and accurately locate blasting holes in the oil shale formation.

In one embodiment disclosed in application Ser. No. 790,350, entitled "In Situ Oil Shale Retort With a Horizontal Sill Pillar", an open base of operation is excavated in the formation at a working level near the top of an in situ retort to be formed, which may be a thousand feet, or more, below the ground surface. A substantially horizontal access drift is excavated at a production level below the base of operation to provide access to a lower portion of the retort site. A void is excavated above the access drift so the void opens into the access drift and terminates below the base of operation at the top of the fragmented mass being formed. This leaves a substantially horizontal portion of unfragmented formation between the top of the void and the bottom of the base of operation. Blasting holes for explosive for expanding formation are drilled from the base of operation into a portion of the formation within the boundaries of the retort being formed. Inasmuch as the working level is much closer to the top of the retort being formed than the distance from the retort to the overburden at the ground surface, this permits more accurate and rapid drilling of blasting holes from the base of operation than from the ground surface. This, in turn, facilitates explosive expansion to form the fragmented mass of oil shale particles in the retort. Explosive is loaded into such blasting holes and detonated for explosively expanding formation towards such as void for forming a fragmented permeable mass of particles containing oil shale in the retort.

In an embodiment disclosed in application Ser. No. 790,350, entitled "In Situ Oil Shale Retort With a Horizontal Sill Pillar", a horizontal sill pillar of unfragmented formation remains between the top of the fragmented mass in the retort and the bottom of the base of operation. The sill pillar has a number of bore holes through it after formation of the fragmented mass. Such bore holes include the upper ends of blasting holes drilled from the base of operation. Such bore holes can be used for access from the base of operation for establishing and sustaining a combustion zone in the fragmented mass below the sill pillar.

Ground water from the formation can leak into the base of operation from natural seepage through the roof or walls of the base of operation. Inasmuch as the base of operation can be used extensively during retorting operations as a work area for operating personnel, ground water collecting on the floor of the base of operation can be a nuisance to such personnel.

Ground water seepage into the fragmented mass from the base of operation can occur through bore holes extending from the base of operation through the sill pillar and into the top of the fragmented mass. Seepage of ground water also can occur through the unfragmented formation of the sill pillar into the top of the fragmented mass if steps are not taken to remove ground water which collects on the floor of the base of operation. Water is a valuable and limited commodity in the Western portion of the United States, and water can be effectively used in retorting operations. For example, water can be converted to steam and mixed with oxygen-containing gas to produce a combustion zone feed for advancing the combustion zone through the fragmented mass.

Excessive seepage of ground water through the sill pillar into the fragmented mass during retorting operations can change the composition of the combustion zone feed gas. Such combustion zone feed gas is a controlled parameter having a known composition and feed rate in order to obtain desirable heat transfer from the combustion zone and product yield from the retort. Seepage of excessive and unknown amounts of water into the fragmented mass can disrupt the desired advancement of the combustion zone and the resulting yield from the retort. For example, if water were to leak into one part of the fragmented mass and not into another part, uneven advancement of the combustion zone could occur.

Thus, it is desirable to collect ground water which seeps into the base of operation during retorting operations, and to recover the collected ground water for a useful purpose, such as process water to be converted into steam for use as a combustion zone feed in retorting operations.

It is believed that ground water intrusion into a spent retort containing treated oil shale also should be inhibited. It is throught that the retorting of oil shale can convert certain minerals in oil shale from insoluble to water soluble forms. Dawsonite and nahcolite are believed to be examples of minerals which are present in oil shale and which can become water soluble. It is believed that ground water contact with water soluble minerals in a spent oil shale retort should be inhibited.

Thus, it is desirable to inhibit seepage of ground water into an in situ oil shale retort even after retorting operations are completed.

SUMMARY OF THE INVENTION

This invention provides a method of inhibiting the flow of ground water into a fragmented permeable mass of formation particles containing oil shale in a subterranean in situ oil shale retort. According to one practice of the invention, a first portion of the formation is excavated to form an open base of operation in the formation. A second portion of the formation below the base of operation is explosively expanded to form an in situ oil shale retort containing a fragmented permeable mass of formation particles containing oil shale, leaving unfragmented formation forming a horizontal sill pillar below the bottom of the base of operation and overlying the fragmented mass. Ground water which seeps into the base of operation is withdrawn from the base of operation. A sump for receiving such water can be formed and water is withdrawn from the sump. At least one trench can be formed in the floor of the base of operation for collecting ground water which seeps into the base of operation and conveying it to such a sump.

In another version of the invention, a plurality of bore holes are formed through the sill pillar, and a casing is placed in at least one of such bore holes. Separate casings can be placed in each of a plurality of such bore holes. Any bore holes not having such casings are sealed. Each casing extends above the floor of the base of operation for inhibiting introduction of ground water into the fragmented mass through the bore holes. The bore holes can be used as a means for controlling retorting of oil shale in the fragmented mass to recover liquid and gaseous products from such a fragmented mass. The bore holes through the sill pillar can be sealed through the sill pillar after completing such retorting operations.

DRAWINGS

These and other aspects of the invention will be more fully understood by referring to the following detailed description and the accompanying drawings, in which.

DESCRIPTION

General Description of Retort Forming

Figure 1:
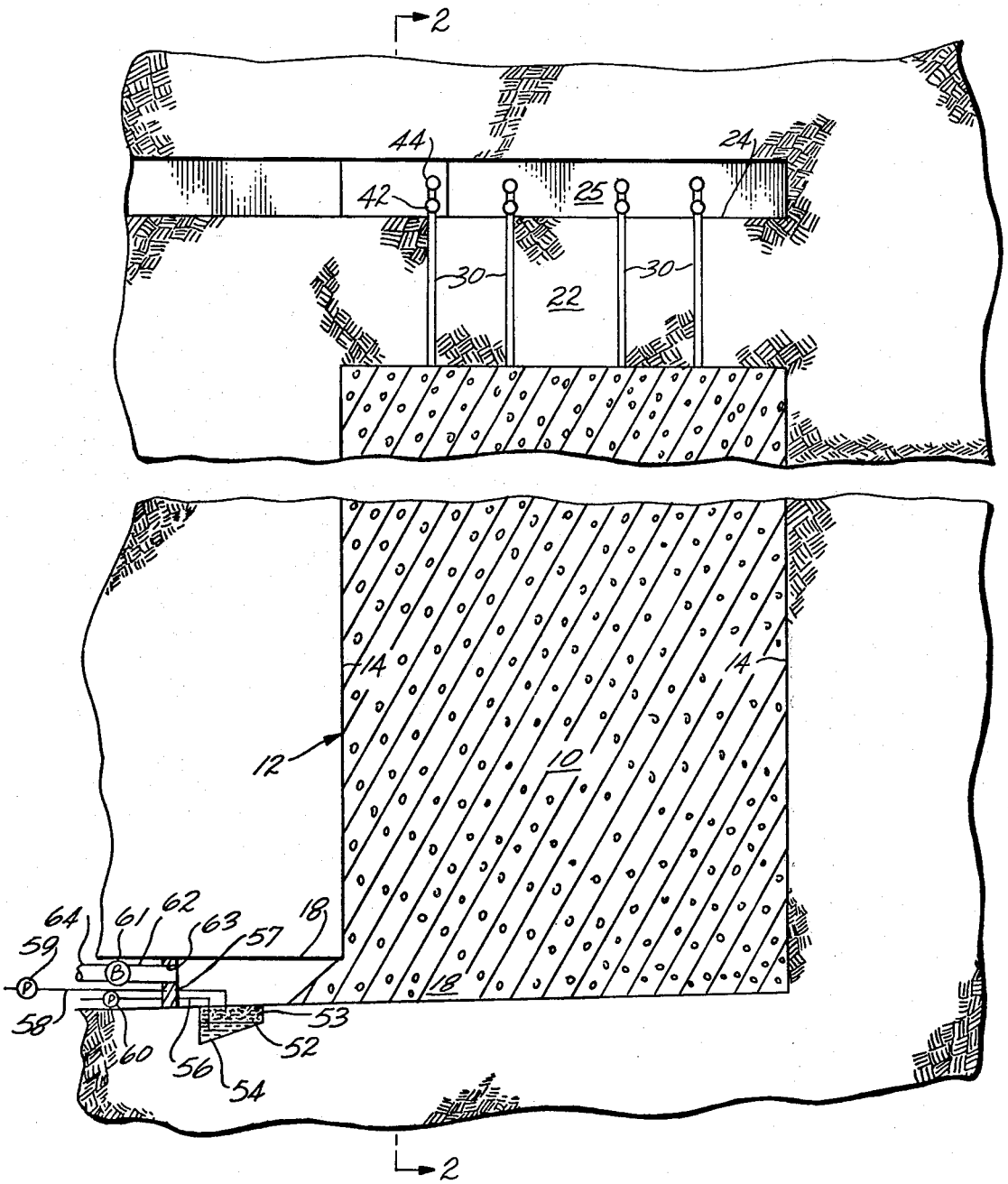
FIG. 1 is a semi-schematic vertical cross-sectional view showing one embodiment of an in situ oil shale retort.

An in situ oil shale retort has a base of operation formed on a working level in a subterranean formation. This working level is at an upper elevation near the top of a retort being formed. A fragmented permeable mass of particles containing oil shale is formed below the base of operation by explosive expansion of formation toward an excavated void. The bottom of the base of operation is separated from the top boundary of the fragmented mass by a horizontal sill pillar of unfragmented formation. The horizontal sill pillar is sufficiently thick that it withstands stresses imposed by explosive expansion, as well as geologic stresses to provide a safe base of operation after formation of the fragmented mass. This permits men and equipment to enter the base of operation over the top of the fragmented mass after explosive expansion. The base of operation on the working level can have a horizontal extent that permits effective access over substantially the entire horizontal cross-section of the fragmented mass, which is of great assistance in forming and operating an in situ retort.

In one method of forming an in situ oil shale retort in a subterranean formation containing oil shale, a portion of the formation is excavated to form a base of operation on an upper working level. A drift or similar means of access is excavated through formation at a lower production level to a location underlying the base of operation at or below the bottom of the in situ retort.

In preparing such a retort, at least one void is excavated from within the boundaries of the fragmented mass being formed, the void being connected to the access drift on the production level underlying the base of operation. This leaves another portion of the formation within the boundaries of the retort being formed which is to be fragmented by explosive expansion toward such a void. Such a void is excavated only to an elevation above the access drift that leaves a horizontal sill pillar of unfragmented formation between the top of the vpoid and the bottom of the base of operation. The surface of the formation defining the void provides at least one free face which extends through the formation, and the remaining portion of the formation within the boundaries of the retort being formed is explosively expanded toward such a free face.

In a preferred embodiment, the horizontal extent of the base of operation over the fragmented mass in the in situ retort is sufficient to provide effective access to substantially the entire horizontal cross-section of the fragmented mass. This does not require that there be an open excavation over the entire horizontal extent of the fragmented mass. Roof-supporting pillars can be left on the working level in a portion of the area directly above the fragmented mass. The size and arrangement of such working level pillars leaves an open base of operation having a sufficient horizontal extent to provide access to substantially the entire horizontal cross-section of the retort site. In one embodiment, a plurality of vertically extending blasting holes are drilled through the sill pillar into formation remaining below the sill pillar. The bore holes are sometimes referred to herein as "blasting holes" inasmuch as they are use to hold explosive for blasting the formation to form the fragmented permeable mass of particles containing oil shale. Such blasting holes can be ten inches or more in diameter. Smaller bore holes can also be present through the sill pillar. Explosive is loaded into such blasting holes from the base of operation up to a level about the same as the bottom of the horizontal sill pillar, which is to remain unfragmented. Such explosive is detonated for explosively expanding subterranean formation toward such a void below the sill pillar, and forming a fragmented mass of formation particles within the retort while leaving unfragmented formations forming the sill pillar.

DETAILED DESCRIPTION

Figure 2:
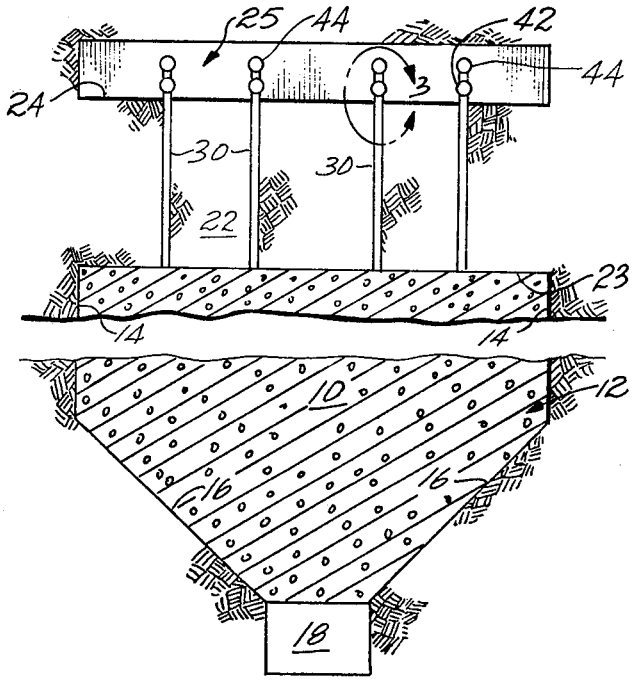
FIG. 2 is a vertical cross-sectional view taken on line 2—2 of FIG. 1.

Referring to FIGS. 1 and 2, a fragmented permeable mass 10 of formation particles containing oil shale is in an in situ oil shale retort 12 in a subterranean formation containing oil shale. The fragmented permeable mass has vertical side boundaries 14 substantially perpendicular to each other to give the retort a rectangular horizontal cross-section. The lower boundary 16 of the fragmented permeable mass slopes downwardly and inwardly (see FIG. 2) at an angle of about 45° and opens into the top of an elongated, substantially horizontal access drift 18 at the bottom of the retort 12. The access drift 18 has a gradual slope downwardly from the center of the bottom of the retort toward a sump 52 for recovering liquid products of retorting at the production level. The fragmented permeable mass also fills the portion of the access drift beneath the retort.

A horizontal sill pillar 22 of unfragmented formation forms the upper boundary 23 of the fragmented permeable mass in the retort. The top of the sill pillar 22 forms the floor 24 of an open base of operation 25 spaced above the fragmented mass retort by a distance equal to the thickness of the sill pillar. In this embodiment the base of operation 25 is an excavation about 12 to 14 feet high at a working level above the retort. It extends over substantially the entire horizontal cross-section of the fragmented mass, and opens at the left (as viewed in FIG. 1) to other excavations at the working level used for exploiting the oil shale deposit. Such underground workings open to a vertical shaft or horizontal adit (not shown).

A plurality of vertical blasting holes 30 extend through the sill pillar. The blasting holes remain in the sill pillar after the blasting which formed the fragmented mass in the retort. The blasting holes are approximately uniformly distributed over the area of the sill pillar 22. In a working embodiment, the horizontal cross-section of the fragmented permeable mass is square, each side being about 120 feet long; and ten inch diameter blasting holes are located at intervals of about 25 feet and about 30 feet in a rectangular grid over essentially the entire horizontal cross section of the fragmented mass. Formation of such an in situ oil shale retort is described in detail in U.S. patent application Ser. No. 790,350, filed Apr. 25, 1977, and entitled "In Situ Oil Shale Retort With a Horizontal Sill Pillar".

During operation of the retort, gas used for retorting of the oil shale is passed downwardly through the fragmented mass. An oxygen-containing gas is introduced into an upper portion of the fragmented permeable mass from the base of operation for sustaining a combustion zone in the fragmented mass of advancing the combustion zone through the fragmented mass. Heat from the combustion zone, carried by flowing gas advances a retorting zone through the fragmented mass on the advancing side of the combustion zone. Liquid and gaseous products are retorted from oil shale in the retoring zone. The production level drift 18 provides a means for collecting and recovering liquid products and withdrawing off gas containing gaseous products from retorting oil shale in the retort 10. A variety of retorting techniques can be used, some of which are set forth in the prior art, so no further description of them is provided herein. A retorting operation including water in the combustion zone feed is described in U.S. patent application Ser. No. 615,558, filed Sep. 22, 1975, entitled "Enriching Off Gas From Oil Shale Retort", by Chang Yul Cha and Richard D. Ridley, now U.S. Pat. No. 4,036,299 and assigned to the assignee of this application. This application is incorporated by this reference.

The base of operation 25 can be used as a location from which to control gas flow through the retort. Separate vertical steel casings 32 are disposed in selected blasting holes. A conventional external packer 34 at the lower end of each casing 32 seals against the casing exterior and the adjacent portion of the horizontal sill pillar 22. The annular space between the casing and the sill pillar above the packer is filled with concrete or grout 36 (commonly referred to as cement) which anchors the casing securely in the sill pillar. In some situations, the casing can be adequately secured by using only the packer, or the cement can be replaced by drilling mud or the like to facilitate removal of the casing after the fragmented oil shale in the retort is completely treated.

Figure 3:
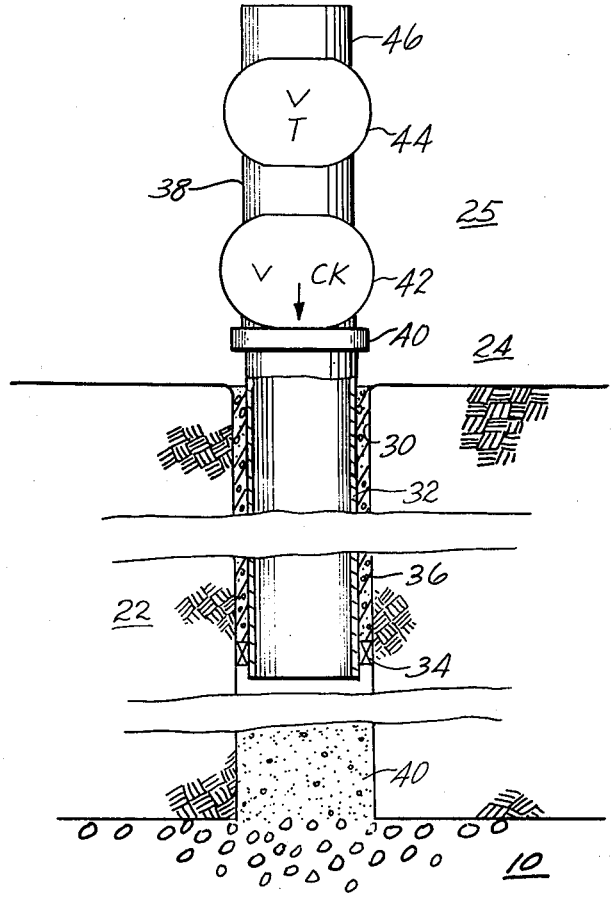
FIG. 3 is an enlarged semi-schematic, cross-sectional view taken within the circle 3 of FIG. 2 and showing a casing sealed through a blasting hole extending through a horizontal sill pillar over the in situ retort.

A casing collar 40 secures an upper section 38 of the casing to the upper end of the casing 32 cemented in the sill pillar. A check valve 42 and a throttle valve 44 (shown schematically in FIG. 3) are mounted in the upper section of the casing. An inlet section 46 connected above the throttle valve admits air from the base of operation into the top of the retort through the throttle valve and the check valve.

A sump 52 in the region of the access drift 18 beyond the fragmented mass collects shale oil 53 and water 54 produced during operation of the retort. A water withdrawal line 56 extends from near the bottom of the sump out through a sealed opening (not shown) in a vertical barrier or bulkhead 57 sealed across the access drift. The water withdrawal line 56 is connected to a water pump 60. An oil withdrawal line 58 extends from an intermediate level in the sump out through a sealed opening (not shown) in the barrier and is connected to an oil pump 59. The oil and water pumps can be operated manually or by automatic controls (not shown) to remove shale oil and water separately from the sump.

The inlet of a blower 61 is connected by a conduit 62 to an opening 63 through the barrier 57 for withdrawing off gas from the retort. The outlet of the blower delivers off gas from the retort through a conduit 64 to a recovery or disposal system (not shown). Thus, the access drift 18 provides means for collecting and recovering liquid and gaseous products from the in situ oil shale retort. A variety of collection and recovery techniques can be used, some of which are set forth in the prior art.

During retorting operations, a combustion zone is advanced downwardly through the fragmented mass by introducing an oxygen-containing gas to the retort through the casings. Gas flow through the retort is preferably generated by the blower 61 which produces a lower gas pressure in the access drift 18 than in the base of operation 25. This draws air from the base of operation, down through the casings, into the fragmented mass. Gas flows down through the fragmented mass in the retort to the production level access drift 18.

Ground water naturally present in the formation can seep into the open base of operation and collect on the floor 24 of the base of operation 25. Ground water flow into the base of operation can be from natural seepage through the roof or "back" and the walls or "ribs" of the base of operation. Accumulations of ground water in the base of operation can be a nuisance to operating personnel working in the base of operation prior to and during retorting operations. Ground water which enters the base of operation could also seep into the fragmented mass slowly if the sill pillar has any fractures.

Excessive seepage of ground water into the fragmented mass can disrupt the control provided over the composition and feed rate of combustion zone feed gas introduced to the combustion zone in the fragmented mass during retorting operations. By controlling the composition and feed rate of the combustion zone feed gas, desired control of the retorting process can be obtained. Seepage of excessive and unknown quantities of ground water into the fragmented mass can disrupt the desired advancement of the combustion zone and the resulting yield from the retort.

According to the present invention, ground water is inhibited from flowing from the base of operation into the fragmented mass.

A sump 96 is excavated on the working level, either within the base of operation 25 or in an adjacent drift. Ground water which seeps into the base of operation is collected in the sump for removal. Ground water 100 which accumulates in the sump 96 is intermittantly or continually withdrawn from the sump by a water withdrawal line 101 and and a pump 102. Such water can be used as process water, reinjected into underground aquifers or otherwise used or disposed of.

Figure 4:
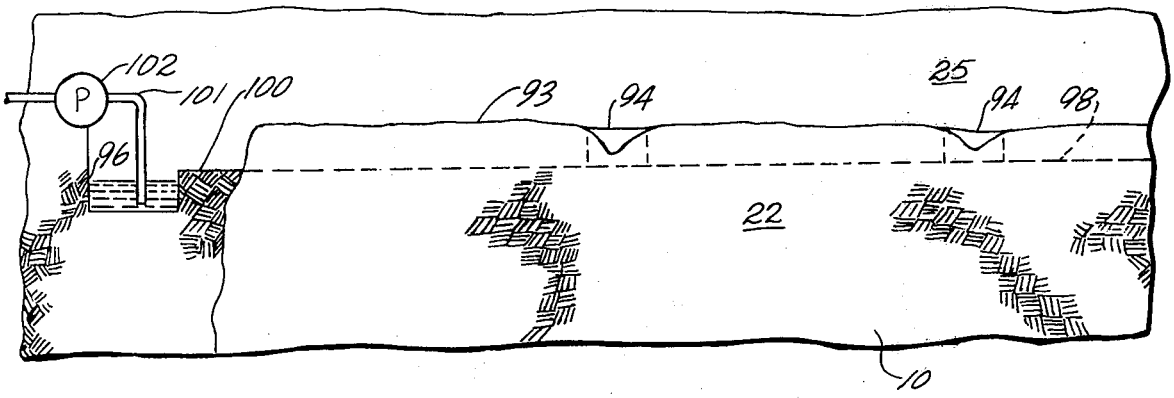
FIG. 4 is a fragmentary, semi-schematic, vertical cross-sectional view showing a method of collecting and withdrawing ground water seeping into a base of operation above a sill pillar in an in situ retort.

One or more trenches 94 formed in the floor of the base of operation to collect ground water which seeps into the base of operation. The trenches 94 are formed in larger depressed areas of the floor where ground water is most likely to accumulate. The trenches 94 are preferably formed in the floor of the base of operation by blasting, although mechanical cutting techniques can be used. The trenches 94 are illustrated in FIG. 4 as being generally V-shaped in cross-section inasmuch as the trenches will be naturally formed in this shape by conventional blasting techniques. Relatively large size formation particles (not shown) can be backfilled into the trenches. Such particles enable ground water to freely flow through the trenches while providing a relatively smooth floor surface in the base of operation and preventing smaller sized oil shale particles from blocking the flow of ground water through the trenches.

The trenches 94 are formed in any desired arrangement so that ground water which collects in them is conveyed to the sump 96. Thus, for example, in an arrangement illustrated in FIG. 4, the plurality of collector trenches 94 slope downwardly from the depressed regions of the floor toward a main trench 98. Ground water which collects in the trenches 94 is conveyed to the main trench 98 which, in turn, slopes downwardly to the sump 96 for conveying the collected ground water to the sump. The main trench 98 can be formed by blasting techniques akin to those used in forming the trenches 94. In a situation where the floor of the base of operation is appropriately sloped, the sump can be formed in a low region for collecting ground water and few, if any, trenches are needed.

The casings 32 in the bore holes 30 inhibit ground water from passing from the base of operation into the fragmented mass via the blasting holes through the sill pillar. As described above, each casing is sealed in a corresponding blasting hole by a layer of cement 36. The cement substantially prevents water seepage by providing a water impermeable layer in the annulus between the casing and the unfragmented formation of the surrounding sill pillar. Further, the casings 32 project above the floor of the base of operation to provide separate dams for preventing ground water on the floor of the base of operation from passing through the blasting holes into the fragmented mass 10.

Thus, water which seeps into the base of operation is collected so that appreciable accumulations of water on the floor of the base of operation are avoided before and during retorting operations. Moreover, water which enters the base of operation is substantially prevented from leaking into the fragmented mass through the blasting holes. Any ground water which collects in the base of operation is withdrawn from the base of operation and then can be put to a useful purpose. For example, the water which is withdrawn can be converted to steam and mixed with an oxygen-containing gas to produce a combustion zone feed for retorting operations in either the fragmented mass 10 or in an adjacent retort site.

Figure 5:
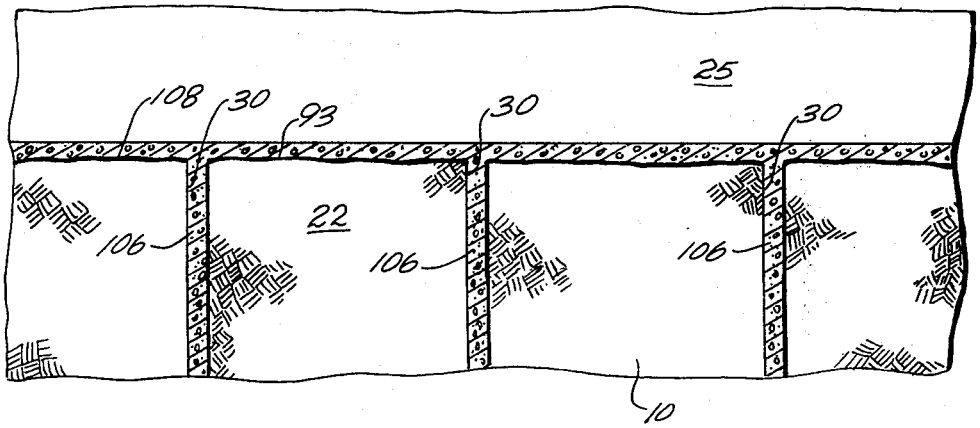
FIG. 5 is a fragmentary, semi-schematic, vertical cross-sectional view showing a method for inhibiting ground water seepage through the sill pillar after retorting operations are completed.

It is believed that ground water intrusion into a completed retort also should be inhibited. It is thought that the retorting of oil shale will convert certain minerals in oil shale from insoluble to water soluble forms, and that ground water contact with water soluble minerals in a spent oil shale retort containing treated oil shale should be controlled. "Treated oil shale" includes retorted oil shale as well as combusted oil shale. Accordingly, the blasting holes 30 through the sill pillar 22 are sealed with a water impermeable material after retorting operations are completed to inhibit introduction of ground water from the base of operation 25 through the blasting holes into the fragmented mass 10. As illustrated in FIG. 5, the casings 32 are preferably removed from the blasting holes 30 after retorting is completed, and the blasting holes are then filled with concrete 36. The casings are removed because corrosion over a prolonged period of time can destroy the casings and could allow ground water to leak from the base of operation through the blasting holes into the fragmented mass. All blasting holes through the sill pillar are sealed after retorting operations are completed. If desired, the entire surface area of the floor 93 in the base of operation can be covered with a layer of concrete 108 following retorting operations. The concrete layer can be poured or sprayed onto the floor of the base of operation. The layer of concrete covering the floor 93 will essentially prevent ground water on the floor 93 from flowing through any portion of the sill pillar and into the fragmented mass.

Thus, water which seeps into the base of operation is inhibited from flowing into the fragmented mass even after retorting operations are completed. This prevents any significant contact between ground water and any water soluble minerals in the treated oil shale.

Although described and illustrated herein with respect to one in situ oil shale retort, it will be apparent that many features can be employed with a plurality of in situ oil shale retorts. Common systems for withdrawing liquid and gaseous products are but one example. A single water sump on the working level can collect water from a number of locations above a plurality of fragmented masses. Extended drainage systems can be provided on the working level for control of ground water.

What is claimed is:

1. A method for inhibiting flow of ground water into a fragmented permeable mass of formation particles containing oil shale in an in situ oil shale retort in a subterranean formation containing oil shale, the method comprising the steps of:

excavating a first portion of the formation to form an open base of operation in the formation;

explosively expanding a second portion of the formation below the base of operation to form an in situ oil shale retort containing a fragmented permeable mass of formation particles containing oil shale, and leaving unfragmented formation forming a horizontal sill pillar below the base of operation and overlying the fragmented mass;

forming a plurality of bore holes through the sill pillar;

placing casings in the bore holes so that the casings extend above the floor of the base of operation and sealing the casings in the bore holes for inhibiting introduction of ground water into the fragmented mass through each bore hole in which such a casing is placed, and sealing any such bore holes not having such casings;

establishing a combustion zone and a retorting zone in the fragmented mass below the sill pillar;

controlling retorting operations from the base of operation by introducing an oxygen-containing gas to the fragmented mass through a plurality of such casings for sustaining the combustion zone in the fragmented mass and for advancing the combustion zone and retorting zone through the fragmented mass;

collecting ground water in the base of operation; and withdrawing the collected ground water from the base of operation to inhibit flow of ground water into the fragmented mass.

2. The method according to claim 1 in which the sill pillar provides a floor surface for the base of operation; and including collecting ground water on top of the sill pillar prior to withdrawing the water.

3. The method according to claim 2 including forming at least one trench in the floor of the base of operation for collecting ground water.

4. The method according to claim 2 including forming a sump for receiving water, forming at least one trench in the floor of the base of operation for conveying water to the sump, collecting ground water in such a trench, conveying the collected ground water through such a trench to the sump, and withdrawing the water from the sump.

5. The method according to claim 2 including forming a sump for collecting water from the floor surface, and withdrawing such water from the sump.

6. A method for inhibiting introduction of ground water into a fragmented permeable mass of formation particles containing oil shale in an in situ oil shale retort in a subterranean formation containing oil shale, the method comprising the stpes of:

excavating a first portion of the formation to form an open base of operation at an elevation in the formation above the fragmented permeable mass being formed;

excavating a second portion of the formation for forming at least one void within the boundaries of the fragmented mass being formed, leaving a third portion of formation within the boundaries of the fragmented mass being formed;

drilling from the base of operation a plurality of blasting holes in such third portion of the formation below the base of operation;

loading explosive into such blasting holes only up to an elevation lower than the bottom of the base of operation;

detonating such explosive to expand such third portion of the formation toward such a void to form a fragmented permeable mass of particles containing oil shale and to leave a horizontal sill pillar of unfragmented formation between the top of the fragmented mass and the bottom of the base of operation;

sealing a casing in at least one of the blasting holes, such casing extending above a floor surface of the base of operation for inhibiting introduction of ground water into the fragmented mass through each blasting hole in which such a casing is placed;

sealing any remaining blasting holes not having such casing; and collecting ground water in the base of operation and withdrawing the collected ground water from the base of operation to inhibit flow of ground water into the fragmented mass.

7. The method according to claim 6 including forming a sump for collecting water from the floor surface, and withdrawing such water from the sump.

8. The method according to claim 6 including establishing a combustion zone and a retorting zone in the fragmented mass below the sill pillar; controlling retorting operations from the base of operation by introducing an oxygen-containing gas to the fragmented mass through a plurality of such casings for sustaining the combustion zone in the fragmented mass and for advancing the combustion zone and retorting zone through the fragmented mass, and sealing at least a portion of such blasting holes after completion of retorting operations.

9. The method according to claim 6 in which the sill pillar provides a floor surface for the base of operation; and including collecting ground water on the floor of the base of operation prior to withdrawing the water.

10. The method according to claim 9 including forming at least one trench in the floor of the base of operation for collecting ground water.

11. The method according to claim 9 including forming a sump for receiving ground water, forming at least one trench in the floor of the base of operation for conveying water to the sump, collecting ground water in such a trench, conveying the collected ground water through such a trench to the sump, and withdrawing the water from the sump.

12. A method for inhibiting flow of ground water into an in situ oil shale retort in a subterranean formation containing oil shale, the retort containing a fragmented permeable mass of formation particles containing oil shale, the method comprsng of steps of:

excavating a first portion of the formation to form an open base of operation in the formation;

explosively expanding a second portion of the formation below the base of operation to form an situ oil shale retort containing a fragmented permeable mass of formation particles containing oil shale, and leaving unfragmented formation forming a horizontal sill pillar below the base of operation and overlying the fragmented mass;

forming a plurality of bore holes through the sill pillar;

retorting oil shale in the fragmented mass via access provided by the bore holes to recover liquid and gaseous products from such a fragmented mass;

withdrawing water from the base of operation during retorting to inhibit flow of water through the bore holes into the fragmented mass; and sealing the bore holes through the sill pillar after retorting oil shale in the fragmented mass.

13. The method according to claim 12 including placing a water impermeable layer over a floor surface of the base of operation to inhibit flow of ground water into the fragmented mass.

14. The method according to claim 12 wherein at least a portion of such bore holes are blasting holes formed in unfragmented formation including the sill pillar and the second portion, and such blasting holes are used for explosively expanding the second portion.

15. The method according to claim 13 in which the water impermeable layer comprises concrete.

16. The method according to claim 12 including sealing the bore holes with concrete.

17. The method according to claim 16 including placing a layer of concrete over the floor of the base of operation to inhibit flow of ground water into the fragmented mass.

* * * * *